United States Patent [19]

Phillips

[11] 4,098,532

[45] Jul. 4, 1978

[54] QUICK ENGAGE AND RELEASE SLING FOR TUBULAR MEMBERS

[76] Inventor: William H. Phillips, Rte. #2, Carthage, Tex. 75633

[21] Appl. No.: 768,994

[22] Filed: Feb. 16, 1977

Related U.S. Application Data

[60] Division of Ser. No. 659,478, Feb. 19, 1976, which is a continuation of Ser. No. 500,915, Aug. 27, 1974, abandoned.

[51] Int. Cl.[2] ..... B66C 1/12; E21B 19/00

[52] U.S. Cl. ..... 294/75; 212/72; 214/2.5

[58] Field of Search ..... 214/2.5, 100; 294/74, 294/75, 78 R

[56] References Cited

U.S. PATENT DOCUMENTS

| | | | |
|---|---|---|---|
| 388,021 | 8/1888 | Byrne | 294/75 |
| 1,181,000 | 4/1916 | Gregg | 294/75 |
| 3,069,738 | 12/1962 | Nelson | 294/78 R |
| 3,129,031 | 4/1964 | Bryant | 294/75 |
| 3,825,129 | 7/1974 | Beck | 214/2.5 |

*Primary Examiner*—Robert G. Sheridan
*Attorney, Agent, or Firm*—Jack W. Hayden

[57] ABSTRACT

A pipe lay down machine which incorporates a main cable adapted to be rigged from the rig floor to a winch overlying a pipe rack where the winch is bidirectionally operable to slack the main line. Wheeled carriages travel up and down the main line. The carriages support releasable pipe connective mechanisms which have a flexible cable extending around the pipe connected to a quick release mechanism. The quick release mechanism includes a transverse bar having protruding ears or tabs which interlock with a rolled lip, thereby anchoring the lever and the end of the cable. Pipe is picked up or laid down by placing slack in the main cable. The carriages traverse the main cable by means of separate winches which apply power to auxiliary lines rigged from winches which are bidirectionally operable to the carriages.

Alternative quick release mechanisms are disclosed. In one form, a cable is looped about the pipe and beneath a spring load pin. The pin is pushed to close and cable tension holds it closed. The delivery of the pipe to the destination is accompanied by slacking the cable whereupon the spring loaded pin is withdrawn and releases the cable. A very desirable alternative device is a hook having an arm appended to it. The arm is easily handled and the hook reaches over a cable or rope looped around a pipe to be lifted. The arm is weighted to drop free on slacking the load on the cable. The handle is weighted to drop away and release.

3 Claims, 12 Drawing Figures

FIG. 2
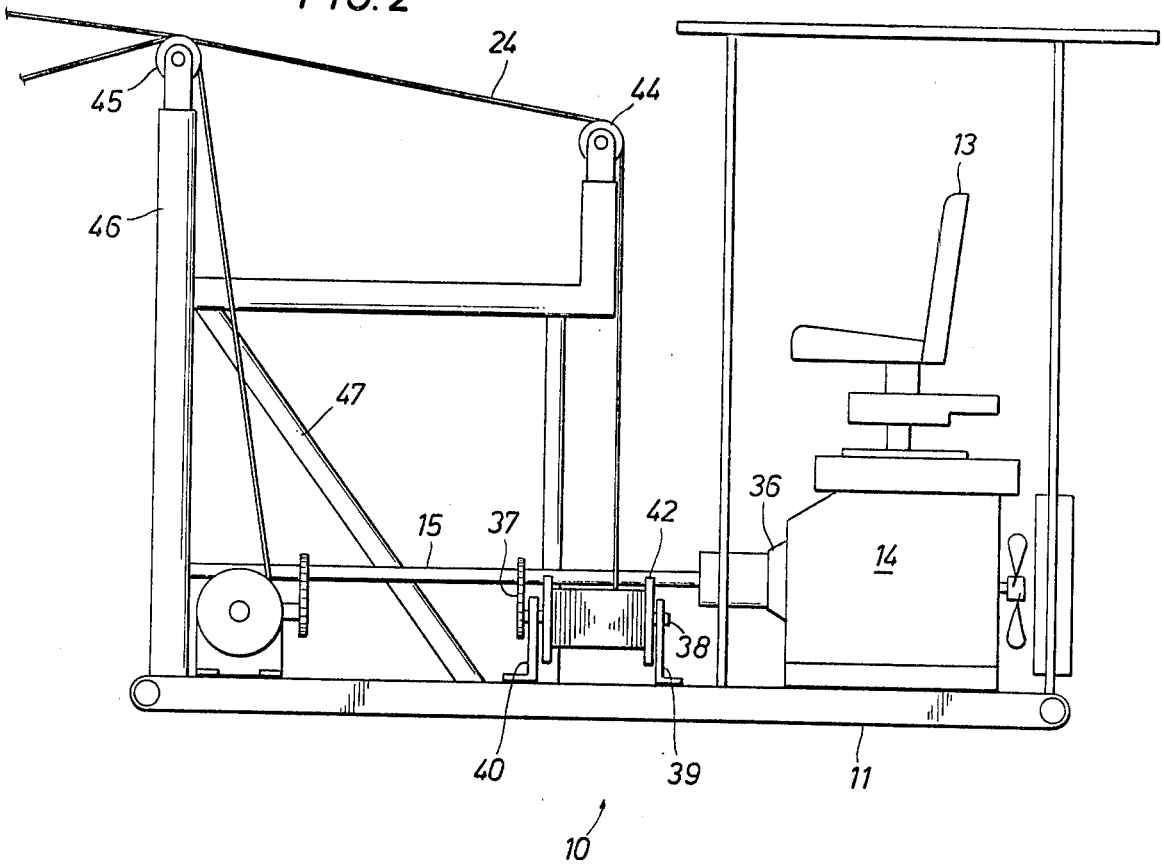
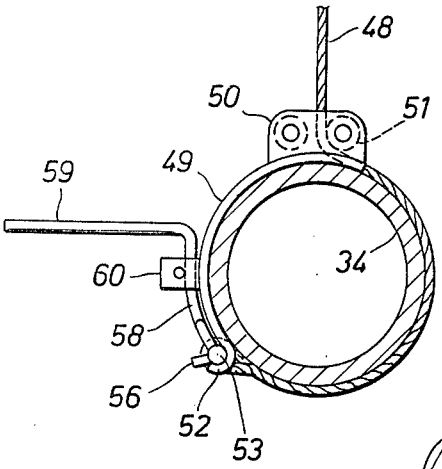
FIG. 4
FIG. 3
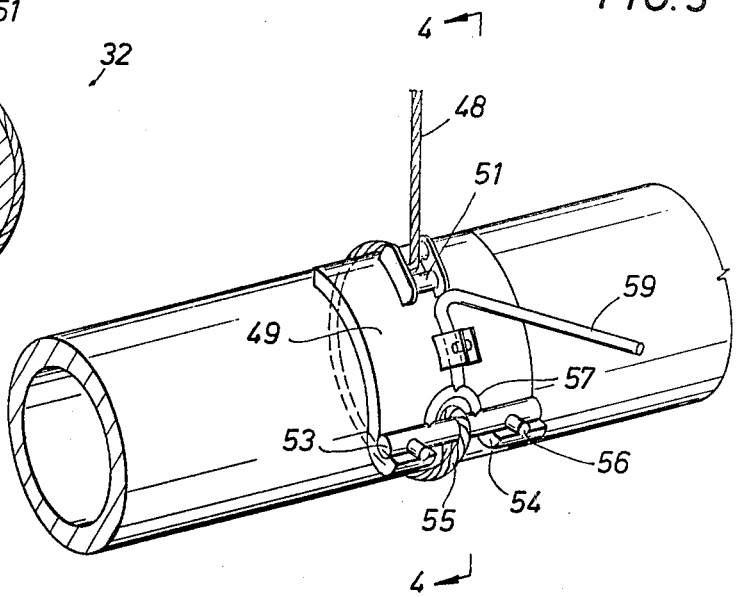

FIG. 5
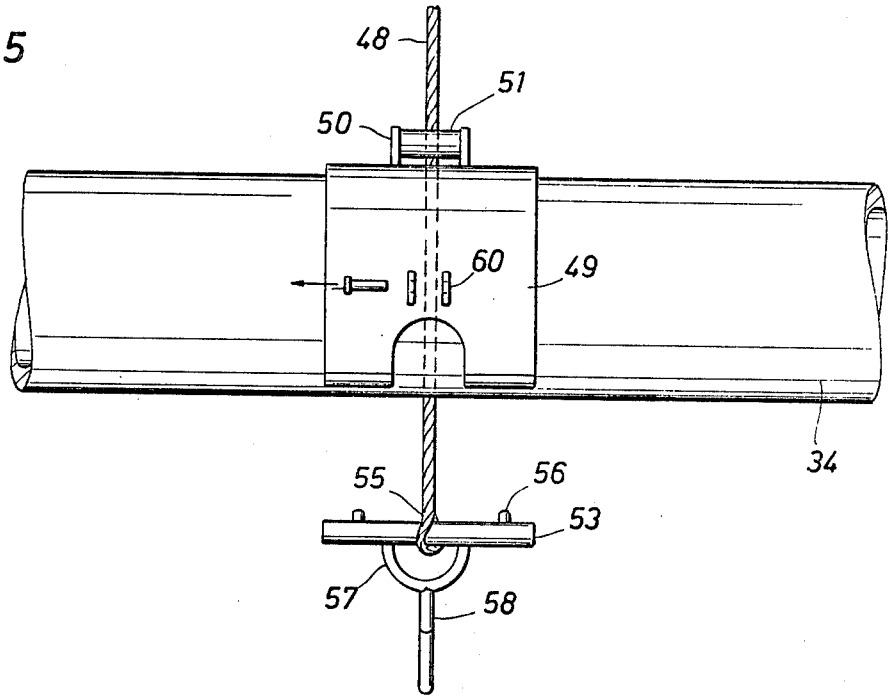
FIG. 6
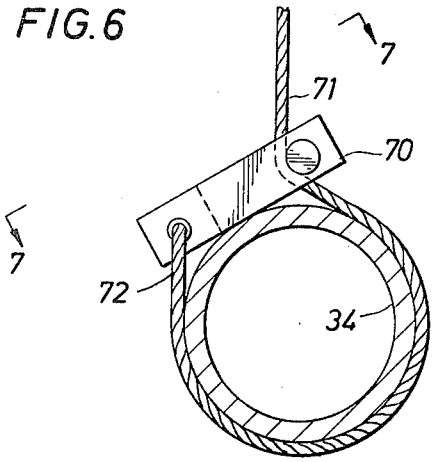
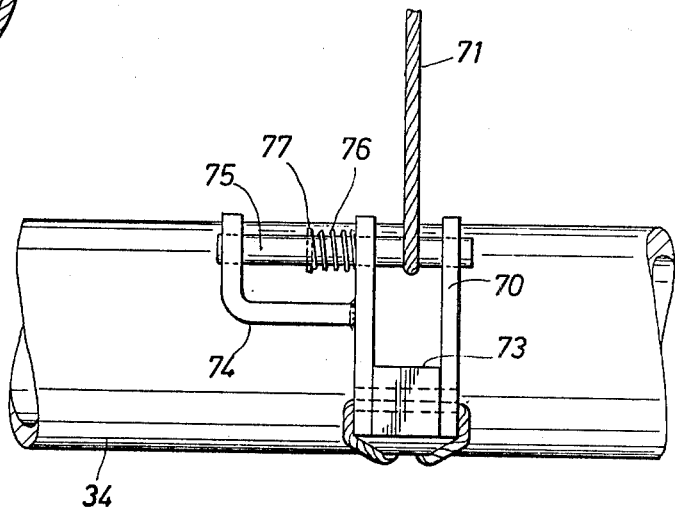
FIG. 7

QUICK ENGAGE AND RELEASE SLING FOR TUBULAR MEMBERS

CROSS REFERENCE TO RELATED APPLICATION

This application is a divisional application of my prior copending application Ser. No. 659,478 filed on Feb. 19, 1976 which in turn is a continuation of my prior copending application Ser. No. 500,915 filed on Aug. 27, 1974 now abandoned.

PRIOR ART

U.S. Pat. No. 1,521,993
U.S. Pat. No. 2,076,758
U.S. Pat. No. 3,253,851
U.S. Pat. No. 1,527,931
U.S. Pat. No. 3,191,787

BACKGROUND OF THE INVENTION

In the drilling of an oil well, it is necessary to move drill collars, drill pipe and other tubular goods to or from the drilling floor. For instance, when a well is completed, the drill pipe is normally removed from the well. When it is removed from the well, it is transferred from the drilling rig platform floor out onto a set of pipe racks. The pipe racks are arranged on the right and left of a cat walk and are adapted to store the pipe horizontally where it can be inspected, transferred to a truck or otherwise moved.

Various and sundry machines have been proposed in the past. The apparatus of the present invention, however, is believed to be quite effective in the handling of drill pipe. It is particularly effective in that it picks up pipe from the platform floor, transfers it from an approximate vertical position to a near horizontal position above the cat walk where the pipe can then be lowered, deposited on the cat walk, and rolled to the right or left onto storage racks. The engagement of the apparatus with the pipe is positive. It is impossible to drop the pipe. When pipe is accidentally dropped, it is potentially dangerous to the workmen in the near vicinity of the pipe rack, possibly causing severe injuries at the worst and at least damaging the threaded members. It is with these problems and others in view that the present invention is offered as a solution to this problem. It is believed that the pipe lay down machine of the present invention is particularly and especially adapted for the handling of pipe in this manner.

SUMMARY OF THE INVENTION

The present invention preferably is a skid mounted, self-powered unit having three winches connected selectively through appropriate drive chains to a power source. The main winch is connected to a main line. The main line is rigged from the equipment in an overlying position above the cat walk to a point at the rig floor. Preferably, a post is positioned in the mouse hole, having a tie point at the upper end, to receive and anchor one end of the main line. The winch raises and lowers the main line by providing slack. Two auxiliary lines are provided with bidirectionally operated winches. They connect to a pair of carriages. The carriages are trolley-like mechanisms which have pulleys engaging the main line and travel up and down the main line, either in response to manipulation by the auxiliary lines or by gravity. The two carriages support connective means. The connective means preferably are formed of a loop of wire connecting with a quick release handle and fixed member which enables a cable to encircle a pipe. This provides a positive mechanism to avoid dropping of the tubular members. The apparatus is connected to the drill pipe and the pipe traverses the main line. The apparatus is adapted to pick up or lay down drill pipe.

DESCRIPTION OF THE DRAWINGS

FIG. 2 is an enlarged view of the motive unit of the present invention showing a power drive system and winches connected to the power drive system;

FIG. 3 shows an encircling connector in accordance with the present invention utilizing a flexible cable and a lever for quick disconnect;

FIG. 4 is a sectional view along the line 4-4 of FIG. 3 showing details of construction of the quick disconnect mechanism;

FIG. 5 is a side view of the quick disconnect mechanism of FIG. 3 showing the cable free after operation of the lever;

FIG. 6 is an alternative pipe connector;

FIG. 7 is a sectional view along the line 7-7 showing additional details of construction of the alternative pipe connector;

DESCRIPTION OF THE PREFERRED EMBODIMENT

Figure 1:
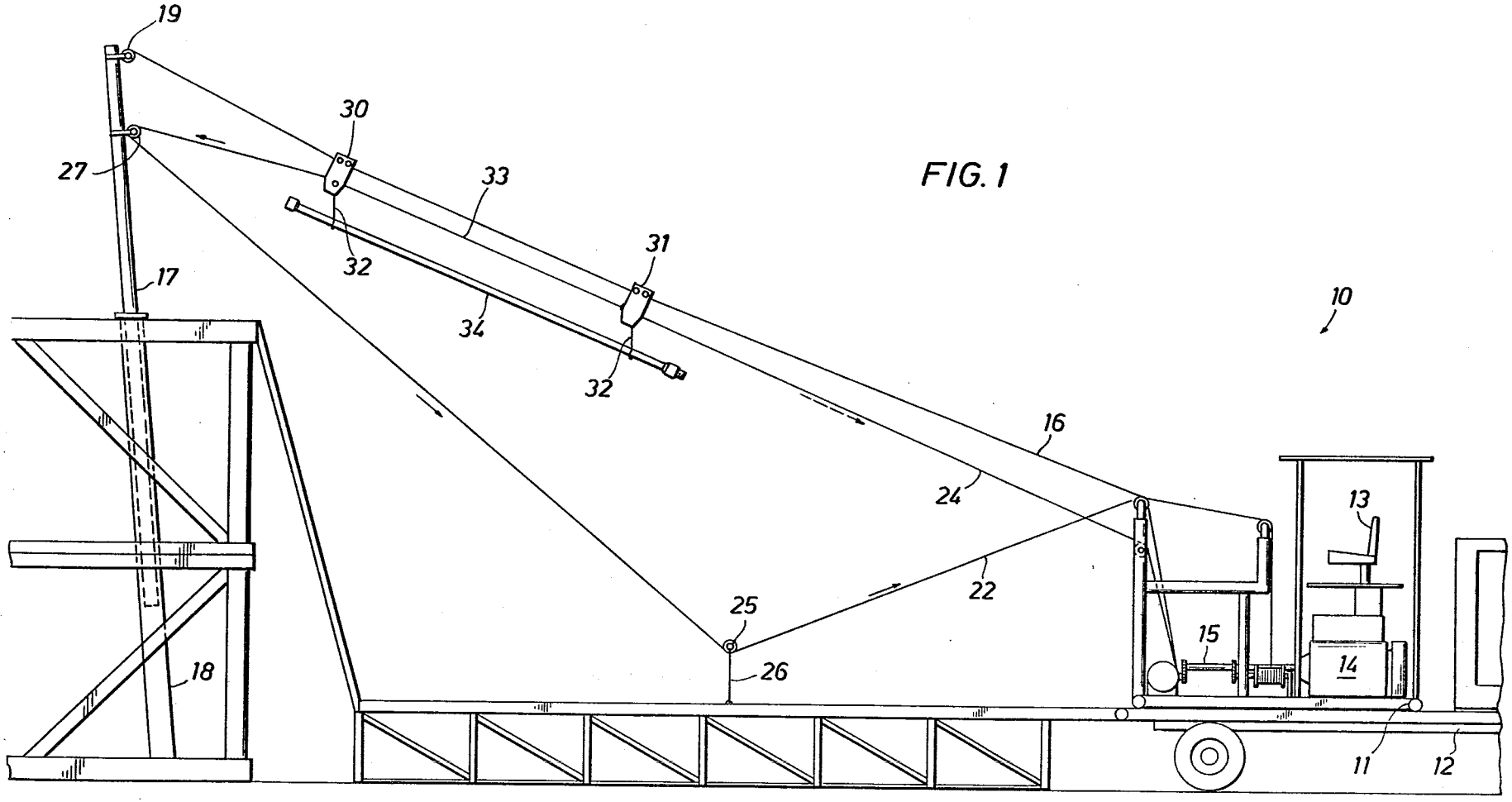
FIG. 1 is a side view of the pipe lay down machine of the present invention shown rigged on a pipe rack and platform.

Attention is first directed to FIG. 1 of the drawings where the lay down apparatus of the present invention is generally indicated at 10. It is mounted on a skid 11 which is carried on a flatbed truck 12. The power unit includes an operator seat 13 where the operator is provided with appropriate controls for the equipment. It is preferably positioned above a power source 14. This enables the operator to see over the equipment, looking up the main line to be described and observing the action at the drilling rig. The power unit 14 may take any form but the preferred form is an internal combustion engine. The power unit 14 provides power to a drive shaft 15. Appropriate winches to be described manipulate three wire lines, the first one being designated by the numeral 16 and referred to as the main line. The main line 16 extends upwardly to a post 17 which is positioned in the mouse hole 18. The post can be any readily stocked piece of pipe such as a worn drill pipe. A leg at the derrick can also be used but good positioning is obtained by placing the post 17 in the mouse hole 18.

The main line 16 is tied to the post 17 at its dead end 19. Any suitable connection will suffice. The addition to the main line, the apparatus has two auxiliary lines identified by the numerals 22 and 24. They are spooled on winches to be described. The line 22 extends somewhat laterally so that it will be away from the path of the drill pipe. The line 22 thus passes over one or two snatch blocks 25 which are anchored by a suitable anchor line 26 at some laterally remote position. Only one is shown although two or three can be included if a circuitous route is required. The line 22 then extends to the rig floor and passes over an additional snatch block 27. The snatch block 27 enables the line 22 to then approximately parallel the main line 16. In the preferred rigging of FIG. 1, the snatch block 27 is supported on the mast 17. Again, it can be located on the rig itself, for instance, at the vee door. The line 22 then extends along or parallel to the main line 16 to a first carriage 30.

The carriage 30 preferably incorporates between one and three pulleys which are mounted on short shafts which engage the main line. The shafts extend between a pair of facing plates having the shape or profile shown in FIG. 1. The pulleys supported by the carriage 30 are free wheeling. That is to say, the carriage 30, absent any restraints, is able to roll on the main line 16 downhill as illustrated in FIG. 1. The auxiliary line 22 is tied to the upper carriage 30. The carriage 30 can be moved along the main line on manipulation of the auxiliary line 22. This will be described in detail hereafter. The carriage 30 has appended to its lower portions a positive connector mechanism 32 which will be described in detail.

The auxiliary line 24 connects with a second or lower carriage 31. The carriages 30 and 31 are preferably identical. They differ only in their location on the main cable 16. They both preferably include the pulleys named above which are located near the top portion of the carriages so that they hang downwardly and position the positive connector mechanism 32 therebelow.

The carriages 30 and 31 at most installations will transfer pipe of a generally uniform length. Most oil field tubular goods are about 30 feet long. To this end, a fixed cable 33 ties the two carriages together to control their spacing. It limits their spacing. The cable 33 is preferably slightly shorter than the pipe 34 which is carried by the mechanism.

Attention is next directed to FIG. 2 of the drawings for additional details. In FIG. 2, the lay down machine 10 is shown in larger scale. It includes the motor or engine 14 which drives the drive shaft 15 through a suitable transmission 36. The drive shaft 15 is equipped with a gear meshed with a chain drive 37 connected through a clutch to a shaft 38. The shaft 38 is supported by a pair of upstanding brackets 39 and 40. The mounting brackets 39 and 40 support the shaft 38 which in turn supports the drum or spool or a sinch 42. The winch 42 stores a substantial quantity of line. The winch is preferably bidirectional in operation. The winch is powered from the drive shaft 15 selectively through a clutch mechanism. If desired, a brake for the winch 42 can be incorporated.

The winch 42 stores a substantial quantity of wire line. The apparatus is equipped with three winches which are substantially identical, one being provided for each line, and hence, a description of one will suffice for all three.

The drive shaft 15 provides power for all three winches. All three are preferably operable in both directions. All three store a substantial quantity of line. The lines 16, 22 and 24 can be similar but preferably the line 16 is of heavier gauge in the range of $\frac{1}{2}$ to $\frac{3}{4}$ inch diameter wire rope. The other lines can be about $\frac{1}{4}$ inch in diameter.

The three winches are arranged on the skid 11 where there is sufficient room. All three lines then extend upwardly from the winches over guide pulleys such as the pulley 44. An additional guide pulley at 45 is shown. The three lines thus extend over the front end of the apparatus which is placed above the skid 11 on an upright framework 46. A transverse bar across the framework 46 supports the pulley 45, there preferably being one for each line. The three lines thus are separated to avoid entanglements.

The framework 46 is of substantial construction and has an angled cross brace 47 connected to the skid 11.

Attention is next directed to FIGS. 3 and 4 where the positive connector mechanism 32 is shown in greater detail. The connector mechanism 32 is shown in the drawings wrapped around a drill pipe 34. The pipe may be, by way of example and not limitation, drill pipe, a bundle of sucker rods, drill collars, etc. The positive connector mechanism 32 incorporates a wire rope 48 which extends from the carriage thereabove. The mechanism 32 includes a curved plate 49 having a radius curvature approximating that of the pipe. It is not essential that the curved plate 49 fit snugly against the pipe 34. Its angular extent about the pipe 34 is subject to variation. It preferably inscribes an angle of less than 180° around the pipe 34.

The curved plate 49 supports a pair of upstanding tabs 50 which are spaced from one another. The tabs 50 support a pair of spaced rollers 51. The rollers 51 are spaced above the plate 49. The wire rope 48 passes between the rollers 51 and extends over the end of the curved plate 49.

The curved plate 49 terminates at the opposite end in a curled lip 52. The lip 52 is curved through approximately 135° to 175° of a circle. Its inside radius is approximately equal the radius of a transverse lock bar 53. The curved lip 52 preferably spans the width of the plate 49. However, it is interrupted at the center by a notch 54. The notch accommodates a loop formed in the end of the wire rope 48, the loop being indicated by the numeral 55.

The lock bar 53 shown in FIG. 3 is approximately as long as the curved lip 52. The lock bar 53 has a pair of protruding tabs 56. They extend along and just above the edge of the lip 52. They are welded to the lock bar 53.

The lock bar 53 is thus connected to the wire rope at the loop 55. The loop 55 is held in position on the lock bar 53 by means of a semicircular welded eyelet 57. The eyelet 57 connects to a lever 58. The lever 58 is curved somewhat to approximate the contour of the plate 49 although this is not a requirement. The lever 58 has a handle 59 which can be grasped by an operator to lock or release.

The lever 58 is positioned between a pair of spaced lock tabs 60. If desired, a removable pin can be placed through appropriate openings in the tab. A pin which locks the handle 59 in position can be inserted through the tab 60.

The positive pipe connector mechanism 32 is placed about the pipe in the following manner. The plate 49 is pressed against the side of the pipe 34. Substantial slack is pulled through the rollers 51. The lock bar 53 is seated in the lip 52. All this can be achieved by the operator grasping the handle 59. As weight is taken on the wire rope 48, the weight pulls the slack in the wire rope and fastens it snugly about the pipe 34. This locks the bar 53 in position. The lip 52 is shaped to hold the lock bar 53 when tension is pulled on the line 48. Any slack in the line 48 usually travels past the rollers 51. The lock bar thus holds its position even without the lever 58. The lock bar 53 is held in position, unable to escape until the handle 59 is rotated. It is rotated out of the overhanging lip 52 pivoting about the edge of the lip 52 where the short tabs or lugs 56 extend past the edge of the lip 52. In other words, disconnection of the lock bar 53 requires rotation against the pull of the cable 48, movement of the lock bar out of the recesses of the lip 52, and movement along a path determined by the overhanging edge of the lip 52. Additional wire rope 48 is fed past the rollers 51 to accomplish this connection.

The lever 59 gives the user substantial leverage in this connection. It is a force multiplying apparatus so that the apparatus can be disconnected from even the heaviest pipe.

Attention is next directed to FIG. 6 of the drawings which shows an alternative embodiment. It is formed by a member having a pair of parallel side plates 70. The apparatus includes a wire rope 71 which is formed into a loop 72 and looped through openings in the side plates 70 and a transverse plate 73 secured to side plates 70 at one end thereof. Transverse member 73 spaces the side plates 70 and they extend therefrom in spaced relation to provide an opening at their other end as shown in the drawings. A hole is drilled through the three members as shown in dotted line in FIG. 7. A lateral arm 74 has an opening for receivng the plunger 75. The plunger 75 is aligned with openings in the side plates 70 and is slidably movable to the right and left in the openings. The plunger 70 is spring loaded by a coil spring 76 to normally retract the plunger from the opening between the plates 70. The spring 76 is held in position by a pin 77 through the plunger. On retraction, the plunger 75 clears the cable as it passes through the side plates 70. When the cable 71 is positioned in the opening between plates 70 after it is looped around pipe 34, plunger 70 may be manually moved laterally to close off the opening. The engagement of cable 71 with plunger 75 when this embodiment is placed around a pipe causes the plunger to remain in the position shown in FIGS. 6 and 7 as long as the weight of the pipe 34 forces cable 71 against plunger 75. When the pipe 34 is laid down and tension in cable 71 looped around pipe 34 is released, then plunger 75 automatically retracts from the opening between plates 70 to release cable 71. The side plates 70 thus serve as a buckle or hook which is hooked over the cable 71. Again, it places a loop around the pipe 34 to hold the pipe firmly and securely against dropping.

The operation of the equipment should be considered. It is rigged typically at the end of the cat walk which normally extends towards the platform and the vee door in the derrick. As shown in FIG. 1, the main line 16 is extended to the area of the platform and tied to the mast 17. The mast supports the main line 16. The carriages 30 and 31 are placed on the main line. The auxiliary cables 22 and 24 are rigged in the illustrated manner. An alternative method of rigging is to run the auxiliary cables 22 and 24 both up to the mast, using a snatch block for both and returning one auxiliary cable to one carriage and the other auxiliary cable to the second carriage to pull the carriages up the main line 16. Gravity return can be used for downhill movement. This is particularly advantageous in laying down pipe. When pipe is laid down, it is necessary to pull both carriages to the vicinity of the platform floor so that workmen can connect the pipe 34 to the connectors 32. When pipe is being moved from the pipe rack to the platform floor, the spacer cable 33 can be used to maintain the carriage 31 remote from the carriage 30 until the pipe has been delivered.

When laying down pipe, the pipe is originally found in a vertical posture above the rotary table at the platform floor. The lower end of the pipe, normally the pin end, is pushed away from the rotary and the connector mechanism 32 engaged with it. The carriage 31 thus supports the lower end of the pipe. The carriage 31 is then permitted to run some distance down the main line. This swings the pipe from a near vertical position to an angled position approximately parallel to the main line 16. At this juncture, the upper end of the pipe or the box end is supported typically in the elevators. When the box end is conveniently close to the operator, he places the connector mechanism 32 supported by the carriage 30 on the pipe 34. The elevators are then disengaged from the pipe 34 and it assumes the angle shown in FIG. 1. The angle of the main line and the pipe supported by it can be varied depending on the length of the main cable, the length of the pipe rack and the height of the platform. In any case, the auxiliary cables are manipulated to trolley the pipe 34 down the main cable. Considering the rigging of the cables 22 and 24 illustrated, the cable 24 is pulled in and the cable 22 is paid out, permitting the pipe 34 to move to a position above the pipe rack. When the pipe 34 is properly positioned above the pipe rack, the main cable is slacked and the pipe 34 is lowered. It is lowered toward the pipe rack and rested on it. The connector mechanism 32 is disengaged and the main cable 16 is again raised, lifting the carriages 30 and 31. The auxiliary cables 22 and 24 are then pulled in the opposite directions to return the carriages 30 and 31 to the vicinity of the rig floor.

The apparatus can be used to pick up pipe also. In this event, a pipe resting on the pipe rack is picked up by first placing slack in the cable 16 with the carriages 30 and 31 positioned above the pipe. As they dip, the connector mechanisms are tied around the pipe 34. The main cable is then made taut and the auxiliary line 22 is pulled in. The cable 24 is paid out, whether under power or by letting the winch connected to it free wheel. The pipe 34 is pulled up the main line until the box end is in the vicinity of the rig floor. The box end of the pipe is then engaged, either in a set of elevators in the draw works or through the use of a lift line and the pipe 34 is then snaked into the derrick moving from an angled position such as that shown in FIG. 1 to a vertical position. The box end is lifted first. This pulls the carriage 31 up to the vicinity of the rig floor where the operator can then disengage the pipe from the carriage 31. When this is accomplished, the pull on the auxiliary line returns the two carriages along the main line 16 for subsequent pickup.

Depending on the use and operation, the auxiliary lines can be rigged in three different ways. The first is that illustrated. The second is to pass the auxiliary line 22 through the carriage 30 which serves as a guide or eyelet for the line 22 so that the line 22 and the short piece 33 are the same cable. The auxiliary line 22 is then tied to the carriage 31 on its uphill side. The line 24 is rigged as illustrated in FIG. 1. The third alternative rigging is to extend both auxiliary lines 22 and 24 somewhat laterally to a snatch block 25 to keep the lines out of the way above the pipe rack, extend both lines to a snatch block at the rig floor and then extend both lines approximately parallel to the main line 16, connecting one to the first carriage and the other to the second carriage. Downhill movement in this rigging is achieved by gravity pull.

The connector mechanism shown in FIGS. 3, 4 and 5 is placed on the pipe quite easily. The plate 49 is moved along the wire rope 48 to form a large loop below the plate to 49. The loop is placed around the pipe. The lock bar 53 is seated in the curled lip 52. This is all that is required to place the device on the pipe. When the pipe is picked up, any excess slack below the rollers 51 is pulled out and the wire rope 48 then tightens around the pipe.

Figure 8:
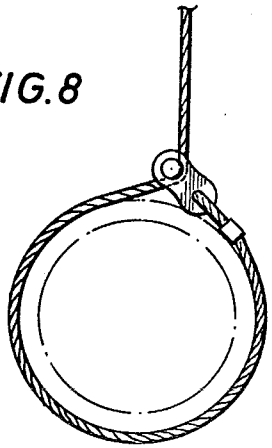
FIG. 8 discloses a simple eyelet which functions as a lariat to hold a pipe.

Attention is next directed to FIG. 8 which shows a lariat type cable arrangement. A chain link serves as an eyelet and enables the cable to be looped through it. The cable is placed over the end of the pipe to encircle the pipe. It is released in the same manner.

Figure 9:
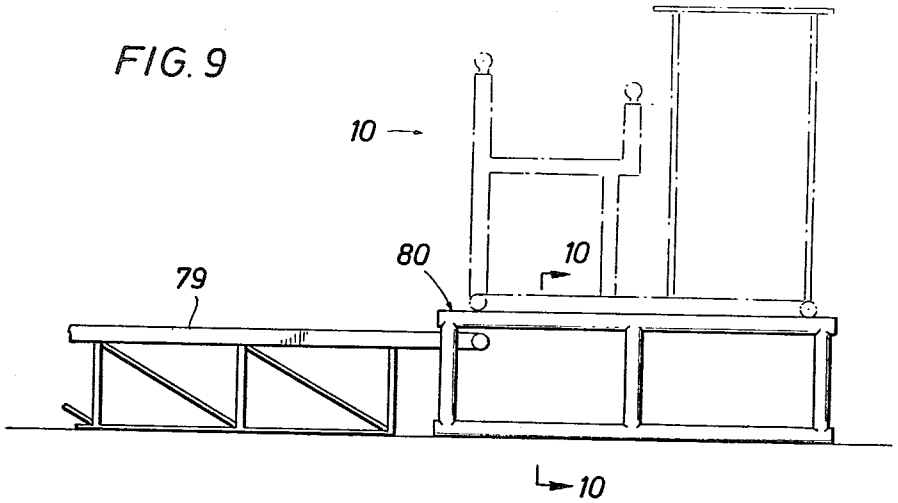
FIG. 9 shows a cat walk extension located at the end of the cat walk for supporting the pipe lay down apparatus of the present invention.

FIG. 9 discloses a cat walk 79 aligned with a cat walk extension 80 supporting the lay down machine 10. The lay down machine 10 is rested on the extension 80 and aligned with the end of the cat walk 79. The lay down machine 10 is preferably chained or bolted to the extension 80. The extension 80 is also chained or otherwise joined temporarily to the cat walk to avoid movement of the extension on loading the cables connected to it. The cat walk extension 80 is preferably ten feet long and has a height of 42 inches, which matches the customary height of cat walks in the industry.

Figure 10:
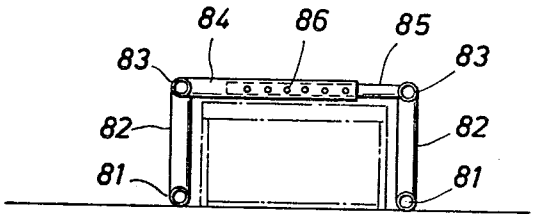
FIG. 10 is a sectional view along the line 10-10 of FIG. 9 disclosing details of construction, enabling the cat walk to be widened to accommodate the hydraulic lines connected to the blow out preventers.

The extension 80 is better shown in FIG. 10 where details of construction are shown. The means by which it expands from four feet to seven feet in width to match most cat walks in width is shown. The apparatus includes horizontal stringers 81 which rest on the surface and vertical posts 82 which support a top side stringer 83. The stringer 83 on the left is connected to a horizontal or transverse hollow frame member 84 of specified diameter. The right hand side is similarly constructed such that the right stringer 83 supports a transverse frame member 85 which telescopes into the member 84. Along the length of the extension 80 is located an adequate number of members 84 and 85 which are matched in location so they all telescope. Thus, four or five sets of members 84 and 85 normally will accommodate the load on the extension 80.

The member 81 - 85 are preferably formed of oil field tubular members. The members 84 and 85 are drilled at 86 to receive a pin which joins them to define a specified width for the extension 80. This is adjustable to accommodate a pipe rack of most widths.

An important feature of the extension 80 is the fact that it is hollow through its middle as illustrated in FIG. 10. Sound safety procedures for most drilling rigs require use of a blow out preventer which is ordinarily connected to two sets of controls. One set of controls must normally be located remote of the rig and to this end, control lines are connected from the rig to a remote location. Because of the traffic and general activities around a rig, a route for the control lines which protects them is along and beneath the cat walk. The extension 80 enables this arrangement to be continued. The extension 80 is able to be used where the truck shown in FIG. 1 cannot be used. The extension 80 boxes in the control lines and protects them from damage.

Figure 11:
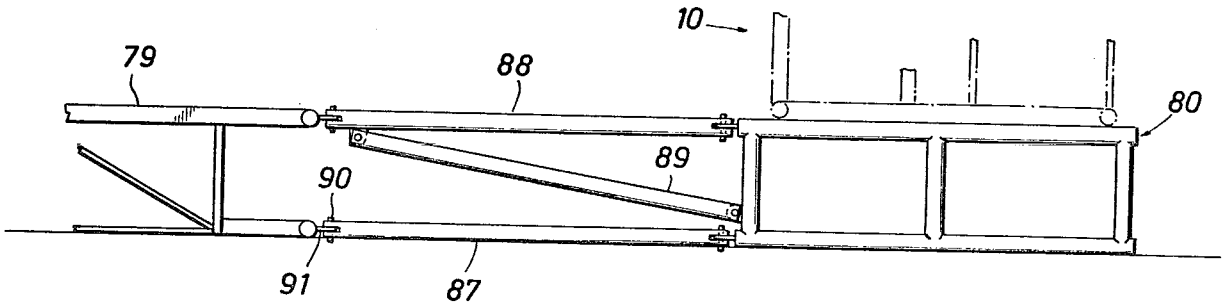
FIG. 11 shows the cat walk extension with an added section providing increased length; and, FIG. 12 discloses an alternative form of connective means which is self releasing and which cooperates with a rope or cable around a pipe.

Attention is directed to FIG. 11 where the extension 80 is joined to the cat walk 79 by a second extension. The arrangement of FIG. 11 is necessary when the cat walk is short or when the pipe or tubing being handled is longer than normal. The extension 80 may not be long enough and this need is overcome by the use of the pin connected frame members shown. A bottom stringer 87, a top stringer 88, and a cross brace 89 are connected between the cat walk 79 and the extension 80. They typically add about ten feet in length to the cat walk. They are joined by placing a pin 90 through a drilled opening in the end of the pipe to engage a tab 91 and thereby pin the members together. The members 87, 88 and 89 are preferably formed of oil field tubular goods. They are duplicated on the right and left of the cat walk to achieve centerline symmetry. It is not normally necessary to include the transverse or vertical members such as those shown at 82, 84 and 85 in FIG. 10. A structurally rigid structure is illustrated in FIG. 11 without added framing members. Tabs are welded to the cat walk and extension and left permanently to enable connection of the pin joined members 87, 88 and 89 from time to time.

Figure 12:
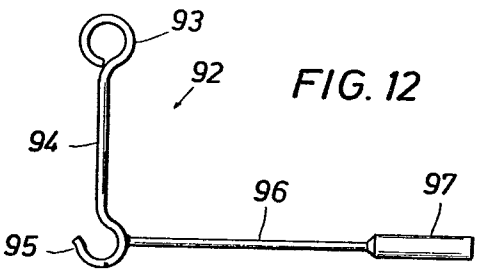

In FIG. 12, attention is directed to another pipe connective means 92. It is adapted to hang by a travelling carriage 31 on the main cable 16. It preferably hangs by a flexible cable or rope. A one inch soft rope or fiber rope will suffice nicely. A flexible wire cable will also suffice, but it may require a larger weight on the means 92. This will be discussed hereinafter.

The means 92 is a hook having an eyelet 93 for connection to the rope or cable, a shank 94 and a hook 95 on the end of it. The hook 95 is looped over the line connected to the eyelet 93 after pulling it around the pipe. The hook 95 reaches and grabs the line. The line and shank 94 encircle the pipe and it is thus captured for lifting.

The hook 95 engages the line on manipulation by a handle 96 having a hand grip 97 on the end of it. This enables safe useage of the means 92. The weight of the handle and the grip causes the hook 95 to fall away from the line.

Consider the following use of the means 92. The cable 16 of FIG. 1 is slacked to drop a one inch fiber rope adjacent to the pipe 34 to be lifted. The rope is looped around the pipe 34 and the hook 95 reaches up and over the pipe 34 to hook the rope. The main cable 16 is lifted and the hook 95 holds as long as there is a load on it. The handle 96 and the grip 97 are approximately perpendicular to the shank 94 and extend clear of the rope and pipe to enable easy handling. The handle and grip cause the hook 95 to fall free of the rope dependent on the rope's flexibility and the slack in it. The hook is weighted to fall free. The hook 95 is pulled away from the rope to release.

One weight adequate for use is a steel hook which is ten inches long from the top of the eyelet 93 to the bottom of the hook 95 where three-quarter inch stock is used to fabricate it. The handle is about twelve inches long, three-quarter inch stock, and the grip is one inch stock and about five inches long. This has been used with one inch rope, typically cut from the cat line. On slacking the line, the hook 95 falls free, all without human intervention.

The hook can easily be hand manipulated on the rig floor or cat walk to reach up and over the pipe to hook the line after encircling the pipe. Release is effected at any location by slacking the line supporting the hook. This is easily done by slacking the main line somewhat and lowering the pipe to some support below it.

The foregoing is directed to the preferred embodiment. Many alterations and variations in its construction and operation can be incorporated. The scope of the present invention is determined by the following claims.

What is claimed is:

1. A quick engage and release sling for tubular members including:

(a) curved means for encircling at least a portion of the tubular member;

(b) said curved means terminating at one end in an arcuate projection extending laterally of said curved means;

(c) means on said curved means for receiving a flexible line therethrough to enable the flexible line to engage with said curved means and encircle a portion of the tubular member;

(d) lock bar means for engaging with the end of the flexible line and with said arcuate projection when said curved means and flexible line are encircled about a tubular member and a tension applied to the flexible line to thereby secure the tubular member in the flexible line and curved means;

(e) projection means on said lock bar means for releasing said lock bar means from said arcuate projection; and (f) handle means connected to said lock bar means to move said lock bar means out of said arcuate projection and effect release between said curved means and lock bar means to disengage the sling from the tubular member.

2. A quick engage and release sling for tubular members comprising:

(a) means for encircling at least a portion of the tubular member;

(b) arcuate projection means extending from said means;

(c) flexible line support means on said first named means for receiving a flexible line therethrough whereby the flexible line and said first named means may engage and encircle a tubular member; and (d) lock means for connecting with the end of the flexible line and engagable with said arcuate projection means when the flexible line is encircled about the tubular member and a tension applied thereto to secure the tubular member in the sling said lock means including:

1. projection means on said lock means of greater longitudinal extent that the extent of said arcuate projection means; and 2. handle means extending from said lock means for manually engaging said projection means and arcuate projection means in a manner to disengage said lock means from said arcuate projection means to thereby release the sling from the tubular member.

3. The invention of claim 2 including means to lock said handle in one position when the tubular member is secured in the sling to inhibit premature release thereof.

* * * * *

UNITED STATES PATENT AND TRADEMARK OFFICE

CERTIFICATE OF CORRECTION

PATENT NO. : 4,098,532

DATED : July 4, 1978

INVENTOR(S) : William H. Phillips

It is certified that error appears in the above-identified patent and that said Letters Patent are hereby corrected as shown below:

Col. 2, line 68, "The" should be --In--

Col. 3, line 53, "sinch" should be --winch--

Signed and Sealed this

*Second* Day of *January 1979*

[SEAL]

*Attest:*

RUTH C. MASON
*Attesting Officer*

DONALD W. BANNER
*Commissioner of Patents and Trademarks*